US006328677B1

(12) United States Patent
Drapeau

(10) Patent No.: US 6,328,677 B1
(45) Date of Patent: Dec. 11, 2001

(54) SIMULATED-KAYAK, UPPER-BODY AEROBIC EXERCISE MACHINE

(76) Inventor: Raoul East Drapeau, 2410 Luckett Ave., Vienna, VA (US) 22180

( * ) Notice: Subject to any disclaimer, the term of this patent is extended or adjusted under 35 U.S.C. 154(b) by 0 days.

(21) Appl. No.: 09/453,904

(22) Filed: Apr. 5, 2000

(51) Int. Cl.[7] ..... A63B 69/06

(52) U.S. Cl. ..... 482/72; 482/55; 482/62; 482/64; D12/302

(58) Field of Search ..... 482/72, 55, 62, 482/102, 64, 907; D12/302; 473/459; 273/108.1

(56) References Cited

U.S. PATENT DOCUMENTS

| | | | | |
|---|---|---|---|---|
| 2,921,791 | * | 1/1960 | Berne . | |
| 3,294,399 | * | 12/1966 | Cugliari . | |
| 4,114,875 | | 9/1978 | Delutu . | |
| 4,336,934 | | 6/1982 | Hanagan et al. . | |
| 4,469,325 | | 9/1984 | Ware . | |
| 4,557,480 | | 12/1985 | Dudley . | |
| 4,625,962 | * | 12/1986 | Street | 272/132 |
| 4,687,197 | | 8/1987 | Larsson et al. . | |
| 4,709,918 | | 12/1987 | Grinblat . | |
| 4,714,244 | | 12/1987 | Kolomayets et al. . | |
| 4,717,145 | * | 1/1988 | Chininis | 272/72 |
| 4,880,224 | * | 11/1989 | Jonas et al. | 272/72 |
| 4,940,227 | | 7/1990 | Coffey . | |
| 5,076,573 | | 12/1991 | Lo . | |
| 5,135,449 | | 8/1992 | Jones . | |
| 5,354,251 | | 10/1994 | Skamaker . | |
| 5,496,236 | * | 3/1996 | Buonauito | 482/57 |
| 5,565,002 | * | 10/1996 | Rawls et al. | 482/6 |
| 5,580,338 | * | 12/1996 | Scelta et al. | 482/62 |
| 5,613,927 | * | 3/1997 | Rothacker | 482/123 |
| 5,624,357 | * | 4/1997 | Englehart et al. | 482/72 |
| 5,803,876 | * | 9/1998 | Hickman | 482/72 |
| 5,957,817 | | 9/1999 | Koenig et al. . | |

* cited by examiner

*Primary Examiner*—Jerome W. Donnelly
*Assistant Examiner*—Lori Baker Amerson

(57) ABSTRACT

A small machine that can be removably mounted on a wall and may be used while sitting or standing to provide aerobic exercise without requiring the use of the legs. The machine simulates the action of a kayak by using an alternating power strokes from the arms, with an inertial component and adjustable retarding forces created by frictional and various speed-dependent mechanisms. A unidirectionally-rotating flywheel simulates the mass of the kayak plus operator, while friction pads, an eddy current generator and air vanes operating on the flywheel provide additional retarding forces. Various ways to grip the ends of the cord are provided, including individual hand grips and a single long shaft with or without paddles at either end.

23 Claims, 13 Drawing Sheets

SIMULATED-KAYAK, UPPER-BODY AEROBIC EXERCISE MACHINE

BACKGROUND OF THE INVENTION

1. Field of the Invention

This invention relates to the field of exercise machines, and particularly to those machines that simulate the action of a kayak, thereby providing aerobic exercise generated by the upper body.

2. Description of Related Art

There is a wide range of exercise machines and devices that provide aerobic exercise, that is, exercise that improves respiratory function by increasing the consumption of oxygen. Treadmills, stair stepping machines and cross-country ski simulators all provide effective aerobic exercise. However, these machines all require the use of the user's legs, either to stand while exercising or to operate the machine. Individuals who cannot use their legs, such as those with an injury, chronic conditions such as arthritis, or who must exercise from a wheelchair, cannot use these machines. There are also those who are able to use their legs while exercising, but do not wish to commit the space required of the existing machines and would like a smaller machine, especially for home use.

The present invention arose out of the need of individuals to have an aerobic exerciser that did not require the use of the individual's legs. Because of its alternating power stroke, continuous action and focus on exercising muscles of the upper body, a kayak provides an excellent aerobic exercise. However, using an actual kayak for exercise it is inconvenient for most people, because of the need for storage space and a suitable body of water. However, the simulation of a kayak provides a useful form of exercise.

A complete simulation of the action of a kayak calls for having components of mass as well as frictional and speed-dependent retardation forces, just as occur in any water craft. The present invention has all of these components.

The present invention includes a small, rigid base plate on which the operating mechanisms are mounted. This plate is in turn removably attached to a fixed surface such as a wall. The user can sit on a chair or wheelchair, or even stand in front of the machine while exercising. Because there is no large, heavy and unwieldy apparatus to take up floor or storage space, when the exercise is competed the machine can easily be demounted and stored.

The machine includes a continuous cord that passes through the machine, around a rotatable drum that translates the alternating linear movement of the cord into a rotation, and out the other side. The user grasps one end of the cord with one hand, and the other end with the other hand. Individual hand grips can be used to facilitate the grip, or in the best simulation of a kayak, each end of the cord attaches to an end of a shaft, with or without paddles at either end. In either example, a spring clasp or other similar device is used to removably attach the grip to the cord ends.

The retarding force and hence the aerobic exercise, derive from the mechanisms attached to the drum around which the cord wraps. One of these is a rotating mass or flywheel that simulates the mass of the kayak and paddler that must be propelled through the water against the retarding forces. In addition, there are retarding forces caused by a set of variably-spring-loaded friction pads that press against the flywheel, a permanent magnet that induces electrical eddy currents in the moving flywheel that in turn react with the magnetic field of the magnet, and a multitude of air-disturbing vanes mounted on the outer perimeter of the flywheel. The machine can employ some or all of these force mechanisms.

One of the unique aspects of this exercise machine is a conversion device that translates the back and forth rotation of the drum into a unidirectional rotation of the flywheel. The device allows a free-wheeling coasting of the flywheel between power strokes that is an accurate representation of the action of a kayak in the water between paddle strokes. Yet, the retarding forces remain in effect at all times, also accurately simulating the action of a real kayak.

Prior art for upper body aerobic exercise machines is of several varieties including lever-operated weight machines, cross-country or alternating arm type, kayak, canoe and rowing simulators. Unlike the present invention, nearly all of these machines consist of a large structure that contains both the part of the machine that generates the inertial and lossy retarding forces, and a part on which the user sits. Also unlike the present invention, others involve separate power and return strokes (e.g. Lo U.S. Pat. No. 5,076,573, Jonas U.S. Pat. No. 4,880,224, Kolomayets U.S. Pat. No. 4,714,244, Ware U.S. Pat. No. 4,469,325, Coffey U.S. Pat. No. 4,940,227), the use of levers to cause motion, rather than a cord (e.g. Hickman U.S. Pat. No. 5,803,876, Larsson U.S. Pat. No. 4,687,197, Chininis U.S. Pat. No. 4,717,145, and Rawls U.S. Pat. No. 5,565,002), lifting weights as the primary work mechanism (e.g. Hanagan U.S. Pat. No. 4,336,934, Jones U.S. Pat. No. 5,135,449 and Koenig U.S. Pat. No. 5,957,817) or when cord is used to actuate the work mechanism, the machine is large and self-contained (e.g. Grinblat U.S. Pat. No. 4,709,918, Street U.S. Pat. No. 4,625,962 and Sleamaker U.S. Pat. No. 5,354,251). Deluty U.S. Pat. No. 4,114,875 and Dudley U.S. Pat. No. 4,557,480 describe small exercise machines that are contained within housings and can be mounted on a fixed surface, but unlike the present invention, both involve a single cord with separate power and return strokes and only one form of retarding force. The closest prior art to the present invention is Englehart U.S. Pat. No. 5,624,357, since it uses a cord and paddle shaft that can be manipulated in three-dimensional space. However Englehart's invention is shown with an integral seat and uses only frictional resistance, thereby not providing a realistic simulation of an actual kayak.

In most cases, the result is a machine that is large, heavy and ungainly. Further, most such machines simulate the rowing action of a boat where both arms work together, first with a power stroke and then a return stroke. Further, they are usually designed to require the use of the legs, an aspect intentionally avoided in the present invention. In the present invention, the exercise machine is small enough to be mounted to a wall for support and easily removed for storage. It also accurately and realistically simulates the action of and forces encountered in paddling a kayak, where the arms work freely in three-dimensional space with alternating power strokes with inertial, frictional and various speed-dependent retarding forces all without requiring the use of the user's legs.

Until the present invention, there was no practical, cost-effective means available of providing a simple, practical, unique, yet different aerobic exerciser that had a frictional retarding force, speed-dependent retarding forces, a single inertial mass or flywheel rotating in one direction and did not require the use of the individual's legs.

SUMMARY OF THE INVENTION

In use, the individual applies a force to one end of the cord, say at the right end of the machine, pulling it out and away from the machine. Since the cord is wrapped around the drum at least once and the drum can be coated with or made from a high-friction material, the linear force is converted into a rotational force without slippage between cord and drum. The opposite end of the cord is automatically pulled into the machine by virtue of being part of a continuous cord.

The cord enters the machine through the conical throat of a cord port made from low-friction material such as Teflon or nylon. The purpose of the port is to accept the varied angles of approach of the cord that result from simulation of the action of a kayak paddle. After exiting the narrow output end of the port, the cord makes a 90 degree turn around a grooved pulley as it heads toward a drum used to convert the linear motion of the cord to rotational motion of the flywheel.

To assure that the cord remains within the concave periphery of the pulley, a spring-loaded idler made of a softer material such as rubber presses against the outside surface of the cord as it lies in the groove of the pulley. In addition, the cord on the return side is not under tension and is thus kept from slipping from the groove. There are other means of assuring this contact between cord and pulley, such as a fixed, curved piece that follows the curve of the pulley for about 90 degree of its periphery.

As the cord is pulled, the friction between the cord and drum causes the drum to rotate. That rotation causes the position of the turn(s) on the drum to slowly "walk" or move toward one end of the drum. When the drum reverses direction, the turns will move towards the other end. The position of the turn(s) continues to move until the cord has reached the end of its stroke. There is generally a small angle between where the cord exits the pulley and the shortest distance to the drum from that point. That angle creates a small component in the force in the cord that lies along the axis of the drum in the direction of the center of the drum and tends to keep the turns together. That force increases as the cord turns move toward the end of the drum.

Additionally, because of the restoring effect of the angle in the cord, after several full cycles, the set of turns will oscillate between extremes centered about the center of the drum, even if their initial position when the cord was at its midpoint was offset from the center. In case the turns begin their movement too close to one end of the drum and continue to move in that direction, the drum has end caps on both ends that serve to prevent the turns from falling off the ends.

The total stroke of the cord, say six feet, divided by the circumference of the drum, say 6.5 inches, determines the number of turns of the drum during each power stroke. Typically, this will be about 11 turns (6 ft×12 in./ft/6.5 in.). If the diameter of the cord is ⅛", then cord will move 1⅜" (11 T/⅛ in.) during that full stroke. During the next power stroke, during which the drum rotates in the opposite direction, the turn(s) of the cord will move the same distance in the opposite direction on the drum. This action then requires a drum of length only somewhat greater than the 1⅜" movement of the turns per stroke.

The drum is fixedly mounted on a drive shaft for the purpose of transmitting power. Also mounted on this drive shaft is a spur gear and a toothed timing belt pulley. Both the gear and the pulley are in turn fixed to their own one-way clutch. Each of these clutches is designed to transmit power in opposite directions. That is, when the gear is transmitting power from the drive shaft through its one-way clutch and then to the gear itself, the timing belt pulley's clutch that is mounted on the same drive shaft is free-wheeling. The reverse is also true. That is, when the drive shaft is rotating in the opposite direction, the one-way clutch attached to the timing belt pulley now transmits power from the drive shaft, through the clutch and hence to the other pulley. On the other hand, the clutch mounted to the spur gear, also on the same drive shaft, is now disengaged and is free-wheeling.

As the drum rotates during this first pull, it causes either the one-way clutch attached to either the gear or the timing belt pulley to accept that power. Whether it is the gear or pulley which transfers power, depends on which one-way clutch is mounted with its power mode in that direction. For the purposes of this discussion, we will assume that the cord is moving to the right as the user pulls with her right arm in a power stroke, and that the drum thus rotates counter-clockwise.

Since it is the gear which accepts power in this case, then its mating gear attached to the output shaft will rotate clockwise, or in the opposite direction from the drive shaft. The ratio of the number of teeth of these two gears will determine the relative rate of rotation of the output shaft.

The output shaft will then cause a flywheel that is also fixedly attached to the output shaft to rotate. The purpose of the flywheel is to simulate the weight of the paddler and kayak through its rotational inertia. The flywheel can be constructed from a single molded or machined piece of metal, or from a disk with an annular cylinder attached to the outer periphery of the disk. As a practical matter, to achieve the largest inertia in the smallest diameter, the outer portion of the flywheel should be a metal such as iron with a high mass density. Regardless of the material used or its construction, the flywheel should have a non-magnetic annular disk outer portion for the generation of eddy current retarding forces, as will be described.

Even though the total weight of a kayak and paddler might easily exceed 200 pounds, it is not necessary to provide that same weight in this machine to properly simulate the operation of an actual kayak. Because the cord wraps around a drum of modest size, say one inch in radius, and the radius of gyration of the flywheel is much greater, say five inches, there is a significant multiplication of the inertia of the flywheel, reflected back to the driving cord. In addition, if the conversion device driving the flywheel provides an increase in rotational speed compared to that of its input shaft, the net effect is a further increase in the effective inertia of the flywheel. Typically, with a two inch diameter drum, a multiplication of 40% of output shaft speed in the direction conversion device compared to input shaft speed, and a flywheel of only 10 pounds weight and 10 inches in diameter, a 10–15 pound stroke force will be necessary to maintain a steady machine speed. This is equivalent of a several mile per hour cruising speed for a 200 pound loaded kayak.

Opposing spring-loaded friction pads can be mounted on the base to apply a retarding force to opposite sides of the flywheel, most conveniently to its disk portion. The arms on which these pads are mounted can be hinged at their opposite ends and be drawn together by the spring, thus creating equal and opposite normal forces on the disk portion. If the arms are slotted and the spring is mounted on bushings that slide in the slots, then movement of the spring in the slots will provide a variation in normal force and resulting frictional retarding force. This retarding force will generally not be a function of rotational speed, and simulates the mostly speed-independent frictional force between the kayak and the water.

There is also a retarding force generated when any water craft such as a kayak displaces water and creates waves when it moves through the water. This force generally varies with speed in a complex way. To simulate this force, a non-magnetic annular disk portion of the flywheel passes through a magnetic field that is perpendicular to the disk and whose strength is greatest near the disk's outer perimeter. This motion induces electric currents, called eddy currents, whose strength is a function of the rotational speed of the flywheel. These currents react with the magnetic field that caused them, resulting in an additional retarding force. The simulation of wave action forces is not exact, but does provide a speed-dependent force component. Because the force exerted on the disk is perpendicular to its radius and is in the plane of the disk, there is no net force on the bearing of the disk that could lead to bearing failure or require the use of a more robust bearing than otherwise would be necessary.

The magnet used for the purpose of creating eddy currents in the mon-magnetic disk can in principle be either an electromagnet or permanent magnet. As a practical matter, a permanent magnet will be assumed, since ones of sufficient magnetic field intensity are easily obtainable, and avoid having any requirement for electrical current.

To achieve a measure of variability in the eddy current retarding forces, the support for the magnet can be designed to move along a radial path of the flywheel without changing the perpendicularity of the magnetic field with respect to the flywheel. Thus, as it moves away from the disk, the number of field lines cutting the moving metallic disk are reduced. The eddy currents also reduce, thus decreasing the reaction force.

Another form of speed-dependent retarding force can be implemented by adding vanes to the outer perimeter of the flywheel. These vanes project into the air as the flywheel rotates and disturb the air. The faster the rotational speed of the flywheel, the greater the retarding force they produce. The vanes also serve to dissipate the heat losses created by the friction pads and eddy currents. These vanes could be variably isolated from the air stream by a movable shield to provide a control on the force they create.

When the full power stroke is complete and the user's right arm is fully drawn back, the stroke can then be reversed such that the left arm now pulls on the cord to provide the power stroke. Inside the machine, the drum is now rotating in the opposite direction from the first power stroke. As a result, the one-way clutch attached to the gear is now free-wheeling, since it was installed to transfer power in the original direction. On the other hand, the clutch attached to the toothed timing belt pulley is now engaged and thus causes the pulley to turn. The power is transmitted smoothly to the output shaft via the timing belt that engages a second toothed pulley mounted to the output shaft.

As a result of this combination of two power transmission methods, each designed to transmit power during a different rotational direction of the drive shaft, the output shaft always rotates in the same direction and always transmits power to the flywheel and retarding force mechanisms, regardless of the direction of rotation of the drive shaft. When the user ceases to pull on the cord, the flywheel will coast, but still under the influence of the retarding forces, further simulating the action of a real kayak. Because of the coasting action of the direction conversion device, there is no large force at the end of each power stroke that would otherwise occur if the rotational direction of the flywheel were also reversed.

The ratio of output to drive teeth in both the gear and timing belt pulleys governs the output shaft speed relative to the drive shaft speed. In order to assure that the output shaft rotates at the same speed regardless of the direction of the drive shaft, these ratios must be close in value.

As the user exercises with the present invention, operating the paddle shaft in three dimensional space and unconstrained by any system of rigid levers, she can move the paddle shaft in a realistic simulation of actual kayak paddling, performing all the usual maneuvers, including paddle twisting as the shaft changes from one hand power stroke to the other. Further, the machine can be mounted low enough on the rigid support (e.g. a wall) such that the force exerted by the cord on the paddle shaft is at a downward angle, as it would be in the case of an actual kayak, thus further enhancing the simulation.

When in operation, the force exerted on the cord during a power stroke and the rate of strokes is such that the machine generates an amount of heat that is easily dissipated by the rotation of the flywheel, particularly if air vanes are installed. Typically at a continuous force of 10 lbs and a stroke of five feet every second, the power generated by the user's efforts is:

$$\text{Power}=10\ \text{lbs}\times[5\ \text{ft}/1\ \text{sec}]\times 1.36\ \text{Watts/ft-lb-sec}=68\ \text{Watts}$$

The base plate to which all the machine's mechanisms are mounted must be attached to a rigid support during operation. One way to accomplish this end is to have a set of mechanical connectors that removably attaches the base plate to a support plate. The support plate can then attache permanently to a wall. If the attachment is such that the cords exit the machine at a level of about two feet off the floor, then the machine can be used while sitting down, making it suitable for individuals in a wheelchair or seated on a chair, preferably of the armless variety.

BRIEF DESCRIPTION OF THE SEVERAL VIEWS OF THE DRAWINGS

An embodiment of the invention is described in more detail with reference to the accompanying drawings, wherein.

It will be recognized that some or all of the preceding Figures do not necessarily show all the elements required to construct the depicted preferred embodiment, or accurately reflect their relative sizes or positions.

DETAILED DESCRIPTION OF THE INVENTION

Figure 1:
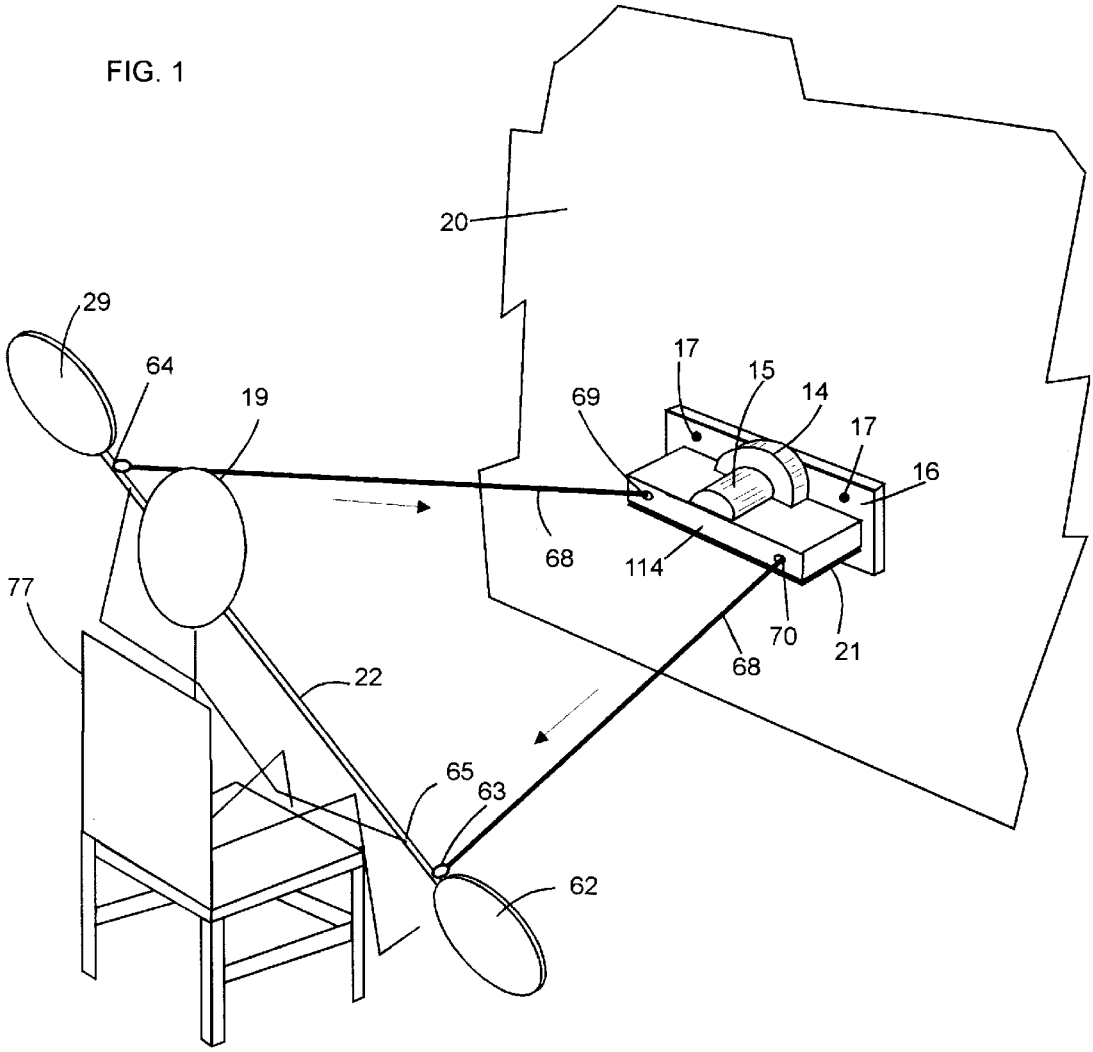
FIG. 1 is a perspective view of a user seated at the exercise machine.

FIG. 1 is a front view of a user 19 seated at a chair 77 facing the exercise machine while holding a simulated kayak paddle consisting of a shaft 22 and paddles 29 and 62. Removably attached to the ends of the shaft at points 63 and 64 are the left and right ends of cord 68. Assuming that the user is shown in a power stroke with the right hand, then the cord 68 will exit the machine at right-hand port 70, while the left hand releases the cord 68 to enter the machine at left-hand port 69.

A safety cover 114 protects the user from the mechanisms. Raised portions 14 and 15 of the cover 114 protect protruding internal mechanisms such as the flywheel and conversion device respectively. The mechanisms are mounted on a rigid base plate 21 which in turn is removably mounted to the support plate 16 by a mechanical connector means (not visible in this view). The support plate is attached to a wall 20 by suitable lag bolts 17.

Figure 2:
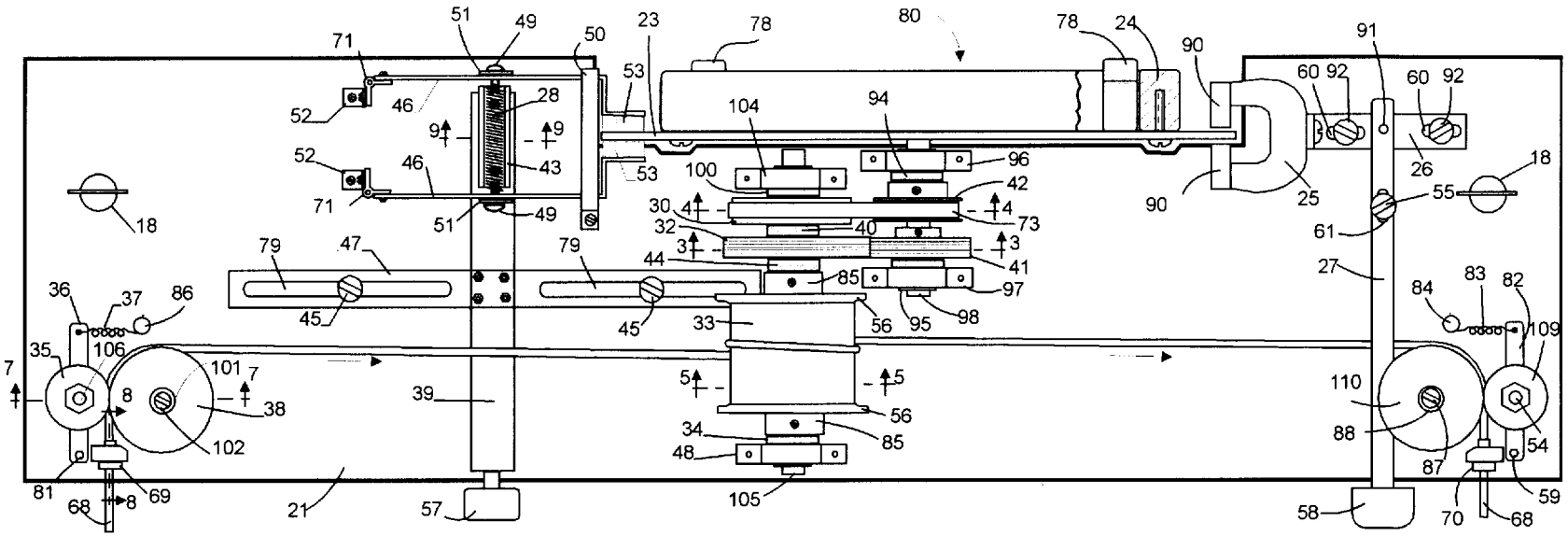
FIG. 2 is an overhead view of the machine base plate containing the mechanisms for transmitting power and exerting retarding force.

FIG. 2 is a top view of the base plate 21 and the mechanisms mounted on it. The base plate 21 is removably attached to a support plate 16 (not shown in this view) by mechanical connectors such as 18. As previously described, the cord 68 is entering the left-side port 69 while exiting right-hand port 70 on a power stroke of the right hand. On the left-hand side of the machine, the grooved pulley 38 with a central sintered bearing 101 is mounted to the base 21 on a shoulder screw 102. The rubber idler 35 mounted on an arm 36 tensioned by a spring 37 anchored at point 86 and pivoted at point 81 serves to apply pressure on the cord 68 to prevent it from coming off the pulley 38 during the current low-tension return stroke. The cord then makes a 90 degree turn and exits the pulley 38 in the direction of the drum 33 as shown by the arrow.

The cord 68 then wraps around the cylindrical drum 33 at least one full turn, and then is directed toward the right-hand side grooved pulley 110, where it is held in place by rubber idler 109 and finally exits the right-hand side port 70.

Drum 33 is attached to the drive shaft 105 by end caps 56 at either end of the drum, the disks having hubs with set screws for securing them in place against rotation. Drive shaft 105 is supported by shaft hangers 48 and 104 having press-fit sintered bearings 34 and 100.

Also mounted on drive shaft 105 are spur gear 32 and timing belt pulley 30, each of which contains a press-fitted one-way clutches (not visible in this view). Each of these clutches is mounted such that their power-transmitting direction is opposite from each other. Spacers 40 and 44 maintain gear 32 and timing belt pulley 30 in their proper position on the shaft.

Engaged with spur gear 32 is spur gear 41, fixedly mounted on output shaft 98. Also fixedly mounted on the same output shaft 98 is timing belt pulley 42 and flywheel 80. Output shaft 98 is supported at either end by shaft hangers 97 and 96, each with press-fit sintered bearings 95 and 94.

As the cord moves from left to right, the drum 33 will rotate counter-clockwise as viewed from the front of the machine. If the one-way clutch mounted to the spur gear 32 is oriented such that it transmits power when the drive shaft 105 rotates counter-clockwise as viewed from the front of the machine, then the spur gear 32 will transmit power to its mating spur gear 41 which will then cause the output shaft to rotate in the opposite direction, namely clockwise.

When the cord reverses direction, the drum 33 and attached drive shaft 105 also reverse direction to a clockwise direction. Since the one-way clutch attached to the spur gear 32 is now in the free-wheeling condition, the drive shaft will not transmit power to the spur gear 32. Instead, the one-way clutch attached to the timing belt pulley 30 will now cause the timing belt pulley 30 to transmit power to its mating timing belt pulley 41 through the timing belt 73. In the reverse direction now being described, the timing belt then causes the output shaft 98 to rotate in the same clockwise direction as the drive shaft 105.

Thus, regardless of the direction that the drum 33 and its connected input shaft 105 rotate, the output shaft 98 will always rotate in the same direction, namely clockwise. Conversely, by reversing the direction of both one-way clutches, the direction of rotation of the output shaft would then be counter-clockwise.

As the cord 68 leaves the drum 33, it passes around a grooved pulley 110 where it is constrained by the rubber idler 109 mounted on arm 82 pivoted at point 59 and tensioned by spring 83 anchored at point 84. Pulley 110 is held in place on base 21 by shoulder screw 87 and sintered bearing 88. Cord 68 then passes through port 70 as it moves in the direction of the user who is pulling on it during the power stroke.

As the user reverses direction of the cord, the rotational direction of the drum 33 will change, but the rotation direction of the output shaft and flywheel 80 will remain the same.

The flywheel may be made of molded or machined construction. As depicted, the flywheel is constructed from a mass 24 having the form of an annular cylinder and attached to a disk 23 that is supported on the output shaft by a hub 93 (not visible in this view). Only partially visible are two of a multiplicity of vanes 78 that provide a speed-dependent retarding force due to their generation of turbulent air flow.

A set of two slotted arms 46 mounted on hinges 71 and brackets 52 are forced together by a tensioning spring 28. Both ends of the spring 28 are attached to bushings 49 that slide in slots (not shown) in the arms 46 on low-friction washers 51. The spring 28 is engaged by a u-shaped bracket 43 that in turn is fixedly attached to control arm 39 and slotted sliding bracket 47. Motion of bracket 47 and hence control arm 39 is constrained to left and right by shoulder screws 45. Knob 57 on the end of arm 39 thus provides control on the force applied to the friction pads 53 by means of changing the lever arm of arms 46. As the control knob 57 is moved to the right, the force pulling the arms 46 together, and hence the force applied to the pads 53 increases. The bracket 50 dampens vibrations in arm 46 and retrains them from moving upwards against the influence of rotating flywheel 80.

Figure 10:
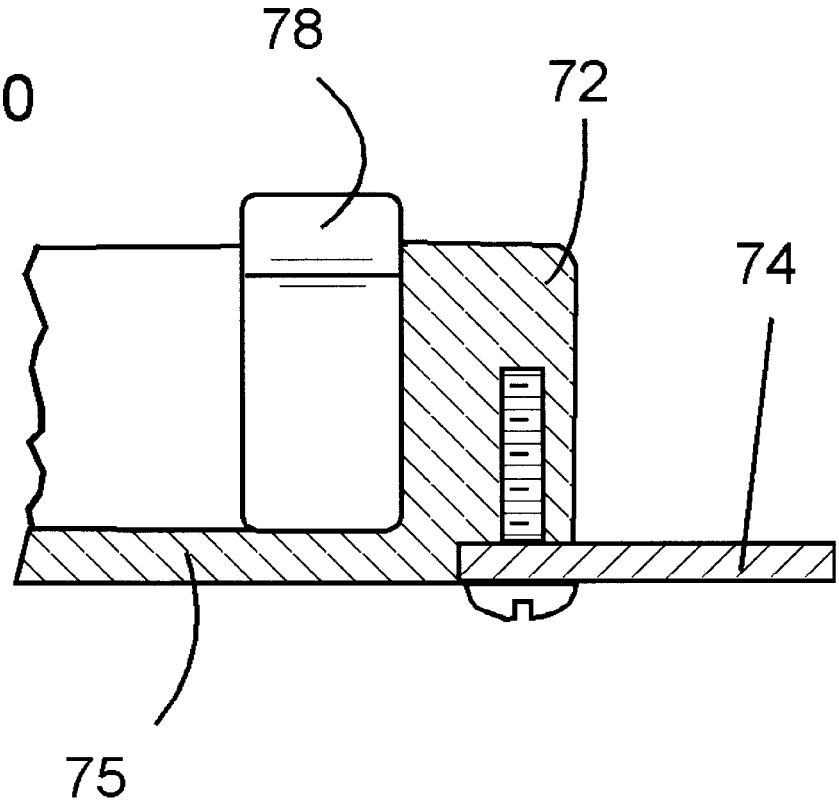
FIG. 10 is an cutaway view of a portion of the flywheel showing an alternate form of the flywheel.

If the flywheel 80 is formed as a single molded or machined piece rather than from a separate disk 23 and annular cylinder 24 as shown, then the friction pads 53 may instead bear directly on the annular cylinder 24 or on an annular disk attached to the molded flywheel, similar to that depicted in FIG. 10.

A magnet 25 is held in place by a sliding bracket 26. Motion of bracket 26 is constrained to a left and right direction by the shoulder screws 92 and the slots 60. The magnet 25 is mounted so that the disk 23 passes with clearance between its two poles 90. The motion of magnet mounting bracket 26 is controlled by control arm 27 and knob 58. Bracket 27 is constrained to a small angle of rotation in the plane of the base plate 1 around pivot 91 by shoulder screw 55 and the slot 61. Moving the knob 58 to the right will move the magnet 25 away from the disk portion 23, thereby intercepting fewer lines of magnetic force and reducing the eddy current generated retarding force.

Figure 3:
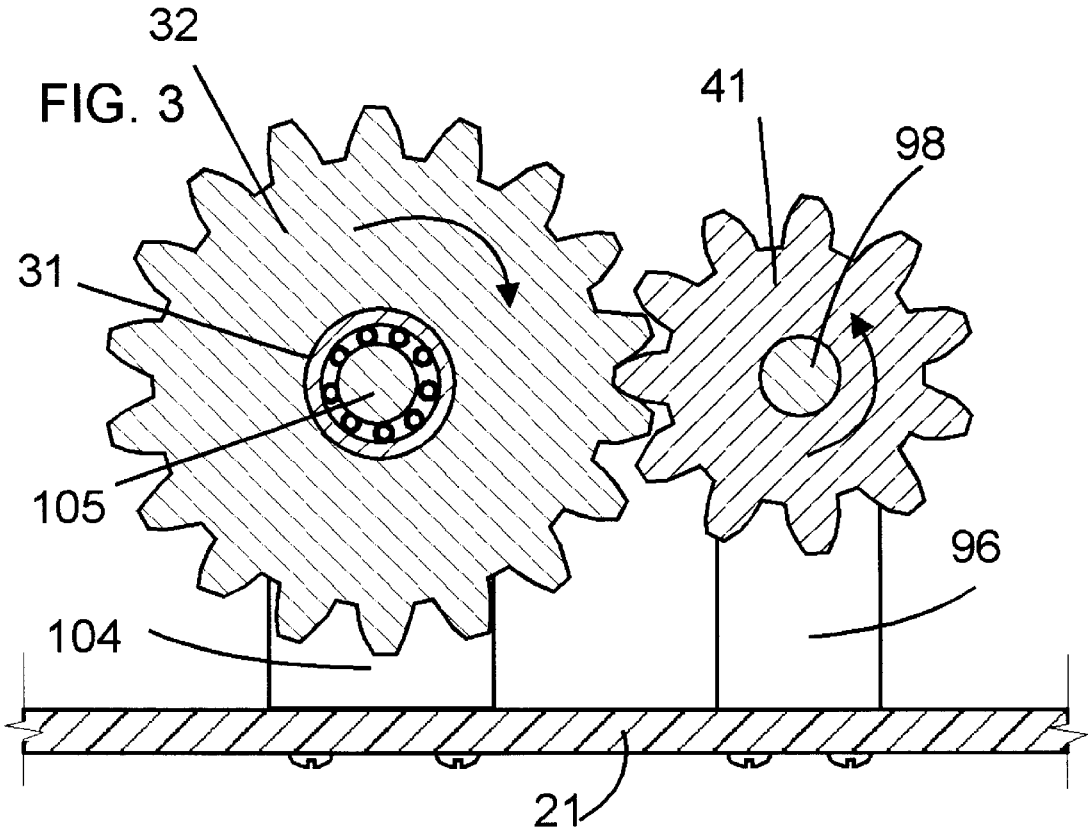
FIG. 3 is a cross-sectional view of a portion of the machine showing the gear train and its one-way clutch.

FIG. 3. is a cross-sectional view of the spur gear train consisting of drive gear 32 and driven gear 41. Drive gear 32 is attached to a one-way clutch 31 and the assembly is mounted on drive shaft 105 such that when the drive shaft rotates in one direction the drive gear will transmit power to mating gear 41 and hence to the output shaft 98, but will not transmit power when rotating in the other direction. Shafts 105 and 98 are supported by shaft hangars 104 and 96, respectively. The arrows indicate the direction of rotation when the gear 32 is transmitting power.

Figure 4:
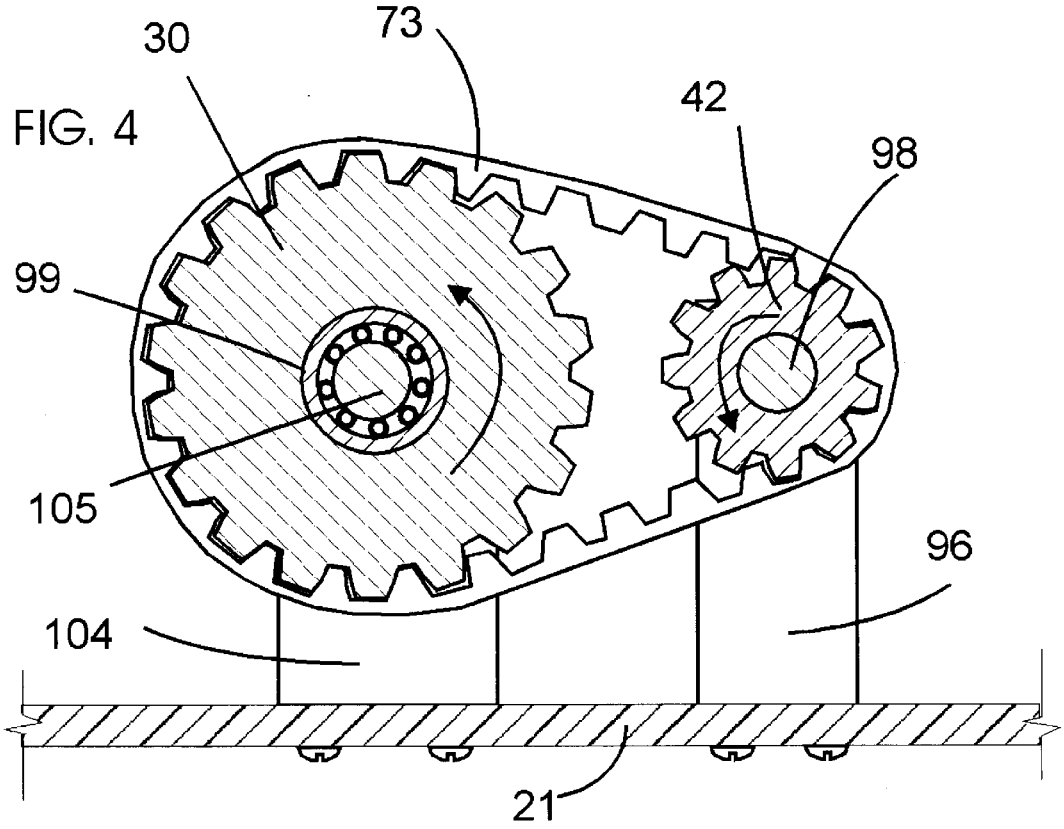
FIG. 4 is a cross-sectional view of a portion of the machine showing the timing belt train and its one-way clutch.

FIG. 4 is a cross sectional view of the timing belt and pulley train, consisting of drive pulley 30, driven pulley 42 and timing belt 73. Drive pulley 30 is attached to a one-way clutch 99 and the assembly is mounted on drive shaft 105 such that when the drive shaft rotates in the opposite direction from that engaging the spur gear train, the drive gear will transmit power through the timing belt 73 to the other pulley 42 and hence to the attached output shaft 98. The arrows indicate the direction of rotation when the timing belt pulley 30 is transmitting power.

Figure 5:
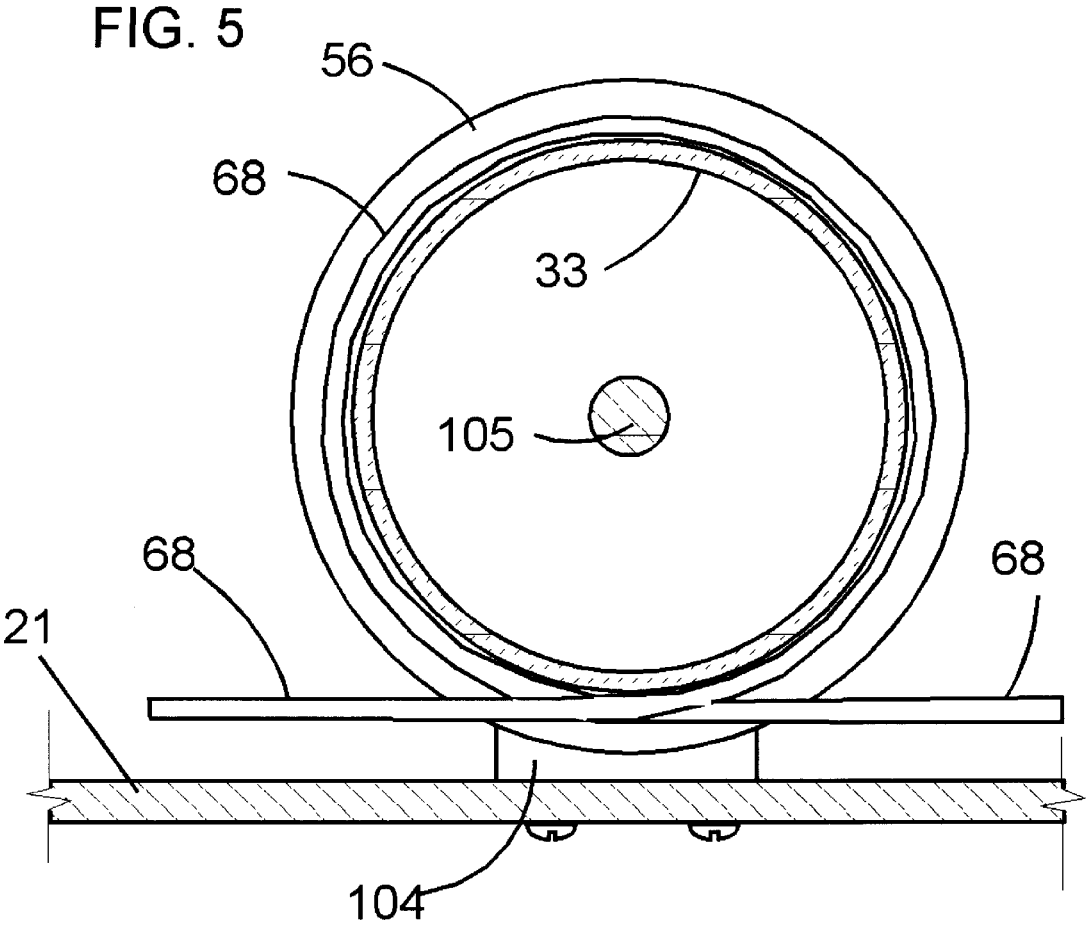
FIG. 5 is a cross-sectional view of the drum.

FIG. 5 is a cross-sectional view of the drum 33, showing one of the rimmed end caps 56 and cord 68 wrapped around the drum. The end caps 56 are fixedly mounted on drive shaft 105 by hubs 85 with set-screws (not shown in this view).

Figure 6:
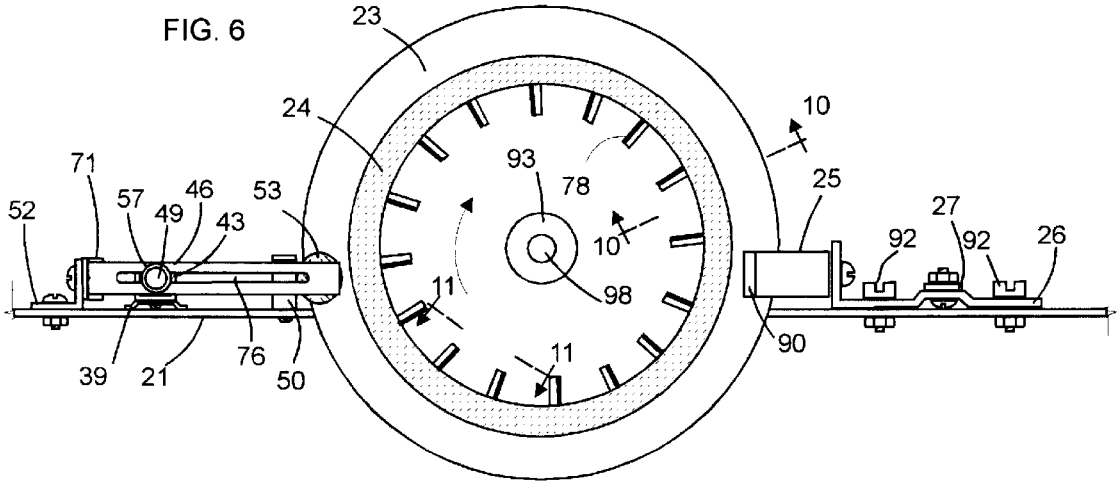
FIG. 6 is a rear view of a portion of the machine showing the flywheel, friction pad and magnet structures.

FIG. 6 is a rear-view of a portion of the machine, showing the disk portion 23, disk mounting hub 93, drive shaft 98, annular cylinder 24, retardant vanes 78, friction pads 53 and magnet 25. Friction arms 46 having slots 76, spring mounting bushings 49, washer 51 and hinge 71 are supported by brackets 52 mounted to base 1. Control bracket 50 is attached to base 21 and prevents upward motion of the arms 46. Control of the spring bushing 49 is effected by bracket 43 and control arm 39, depicted in greater detail in FIG. 9.

Magnet 25 with poles 90 is attached to bracket 26 and held in place to base 21 by shoulder screws 92 that permit left and right movement. Control arm 27 moves bracket 26, thereby moving the magnet closer or farther from the disk 23.

Figure 7:
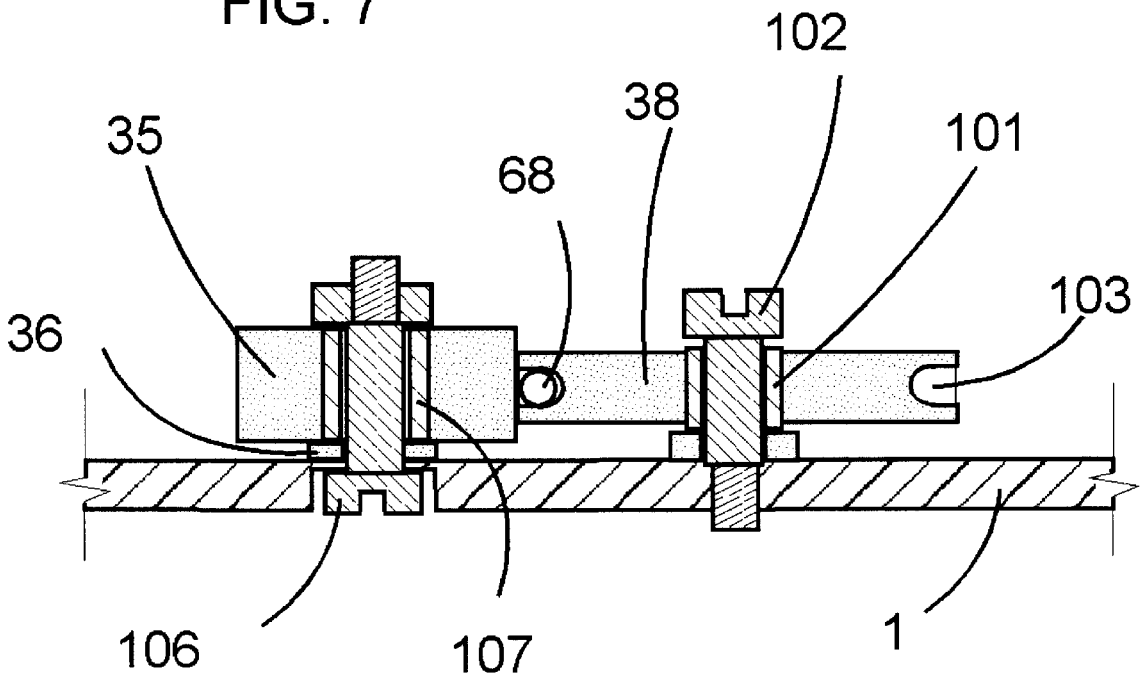
FIG. 7 is a cross-sectional view of a portion of the machine showing the grooved pulley and rubber idlers.

FIG. 7 is a cross-sectional view of a portion of the machine, showing the grooved pulley 38 with integral sintered brass bearing 101 and cord 68 passing around grooved edge 103. The pulley is mounted to base 21 by a shoulder screw 102. Pressing against cord 68 in groove 103 is rubber idler 35 with sintered bearing 107 and held onto a spring-loaded bracket 36 by shoulder screw 106.

Figure 8:
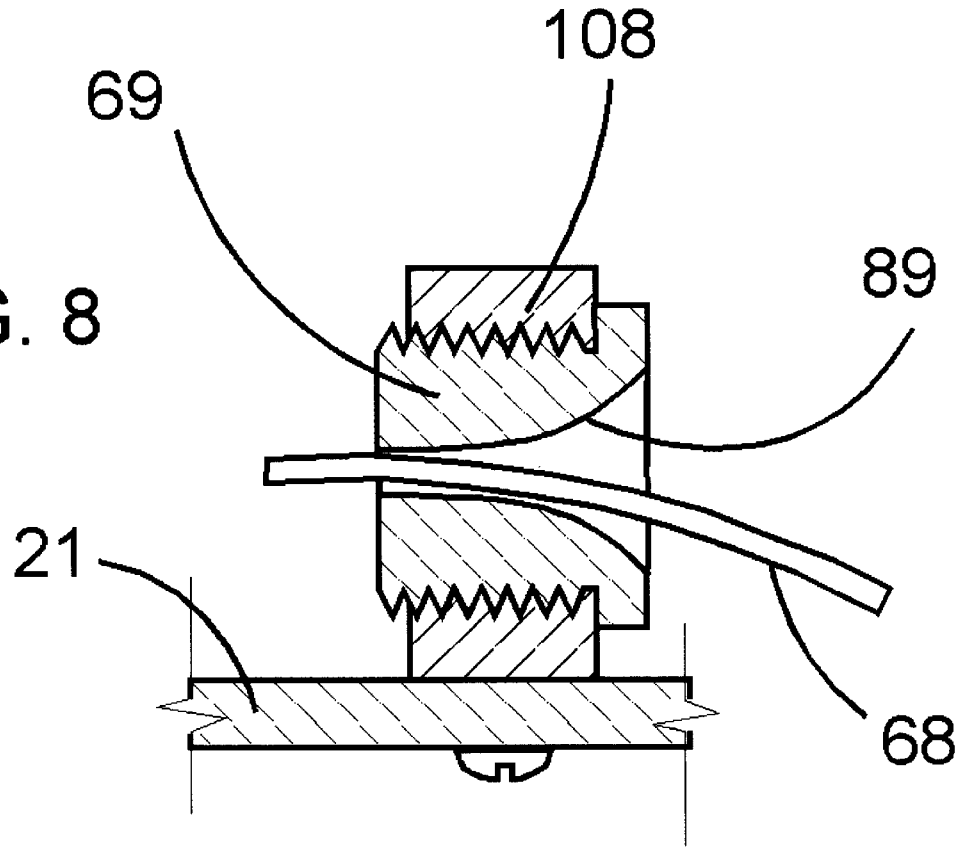
FIG. 8 is a cross-sectional view of the cord port.

FIG. 8 is a cross sectional view of one of the cord ports 69 consisting of mounting bracket 108 that secures port 68 to base plate 21. The throat of port 69 (i.e. facing away from the machine) is larger than that on the interior side to allow for variations in angle of approach of the cord 68. The port can be made of any low friction material, such as nylon or Teflon.

Figure 9:
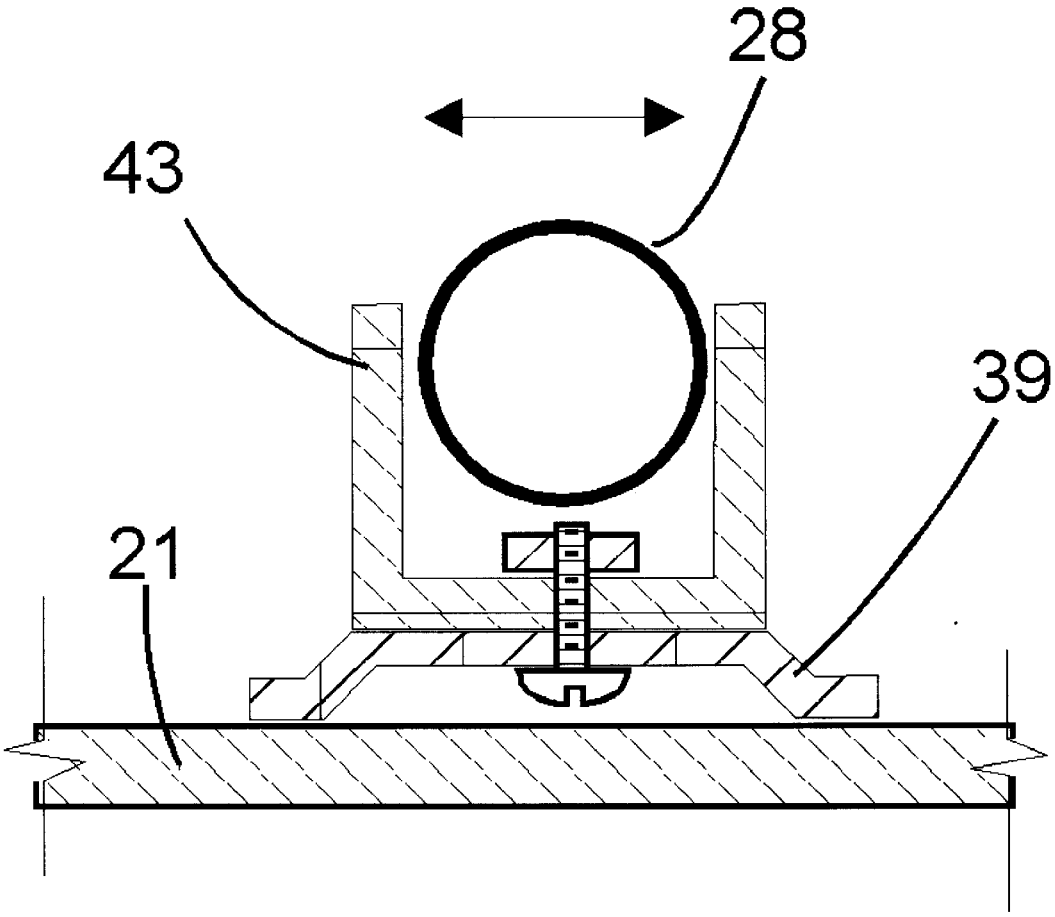
FIG. 9 is a cross-sectional view of the friction arm tensioning spring and its control bracket and arm.

FIG. 9 is a cross-sectional view of a portion of the machine showing the control bracket 43 for the friction pad support arm tensioning spring 28. The bracket 43 is attached to control arm 39. The structure depicted moves in the directions indicated to vary the tensioning force applied to the friction pads.

FIG. 10 is a top view of a portion of the machine showing an alternate construction of the flywheel 80. In this construction, the flywheel is a single molded or machined piece having a disk-like central portion 75, vanes 78 and an annular cylindrical portion 72. Attached to the flywheel is an annular disk 74 that is used in the same way as depicted in FIG. 2 for frictional and magnetic retarding force generation.

Figure 11:
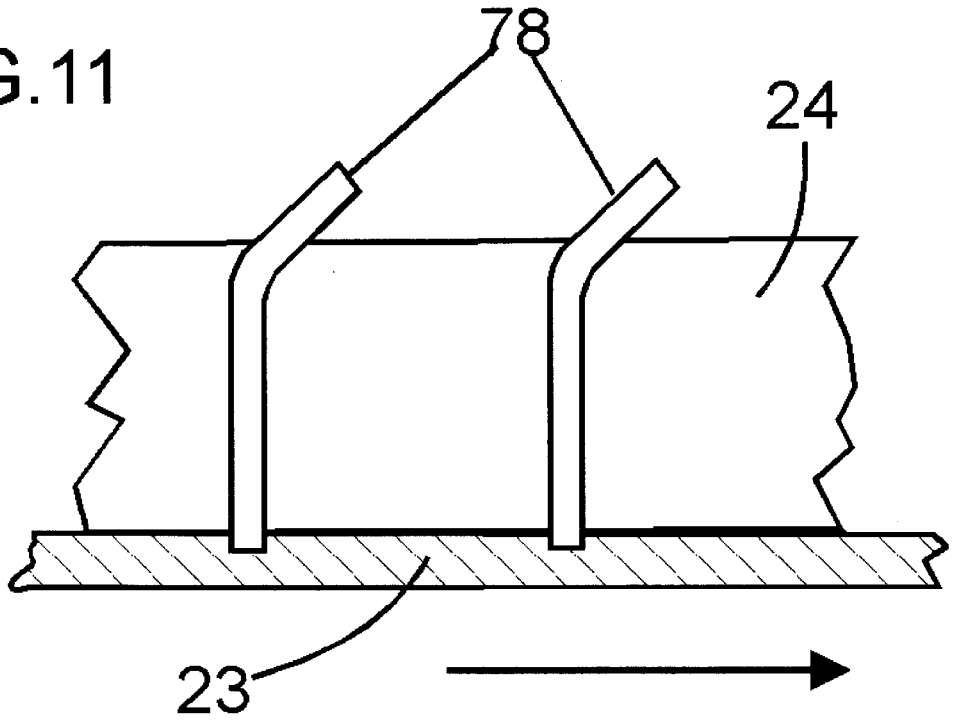
FIG. 11 is a cutaway view of a portion of the flywheel showing air vanes.

FIG. 11 is a cross-sectional view of a portion of the machine showing several air vanes attached to the flywheel 80. In this construction, vanes 78 are attached to the outer periphery of the flywheel disk 23 next to the flywheel mass 24. The vanes 78 are oriented to intercept the air flow when the flywheel rotates in the direction indicated by the arrow, thereby creating a turbulent, speed-dependent air flow that further contributes to the retarding forces.

Figure 12:
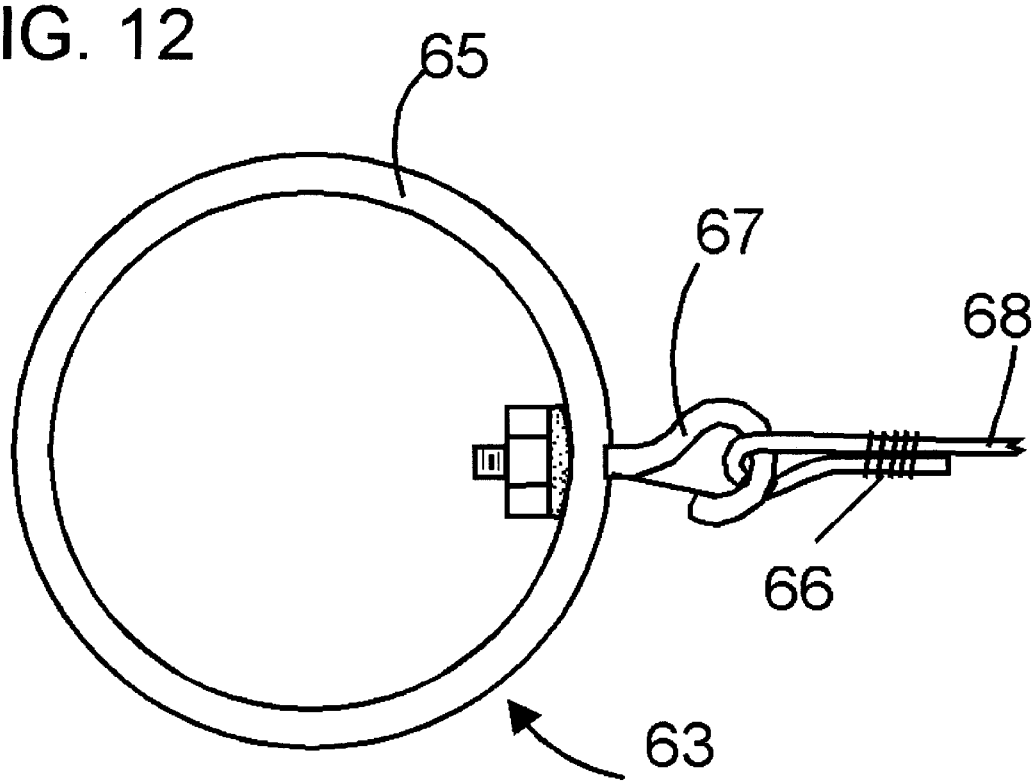
FIG. 12 is an end view of the paddle shaft showing a spring clasp and cord end.

FIG. 12 is an end view of the paddle shaft 65, showing the spring clasp 67 that is fixedly mounted to shaft 65 and is used to removably attach the cord 68. A loop in cord 68 is created and held fast by turns of thread 66.

Figure 13:
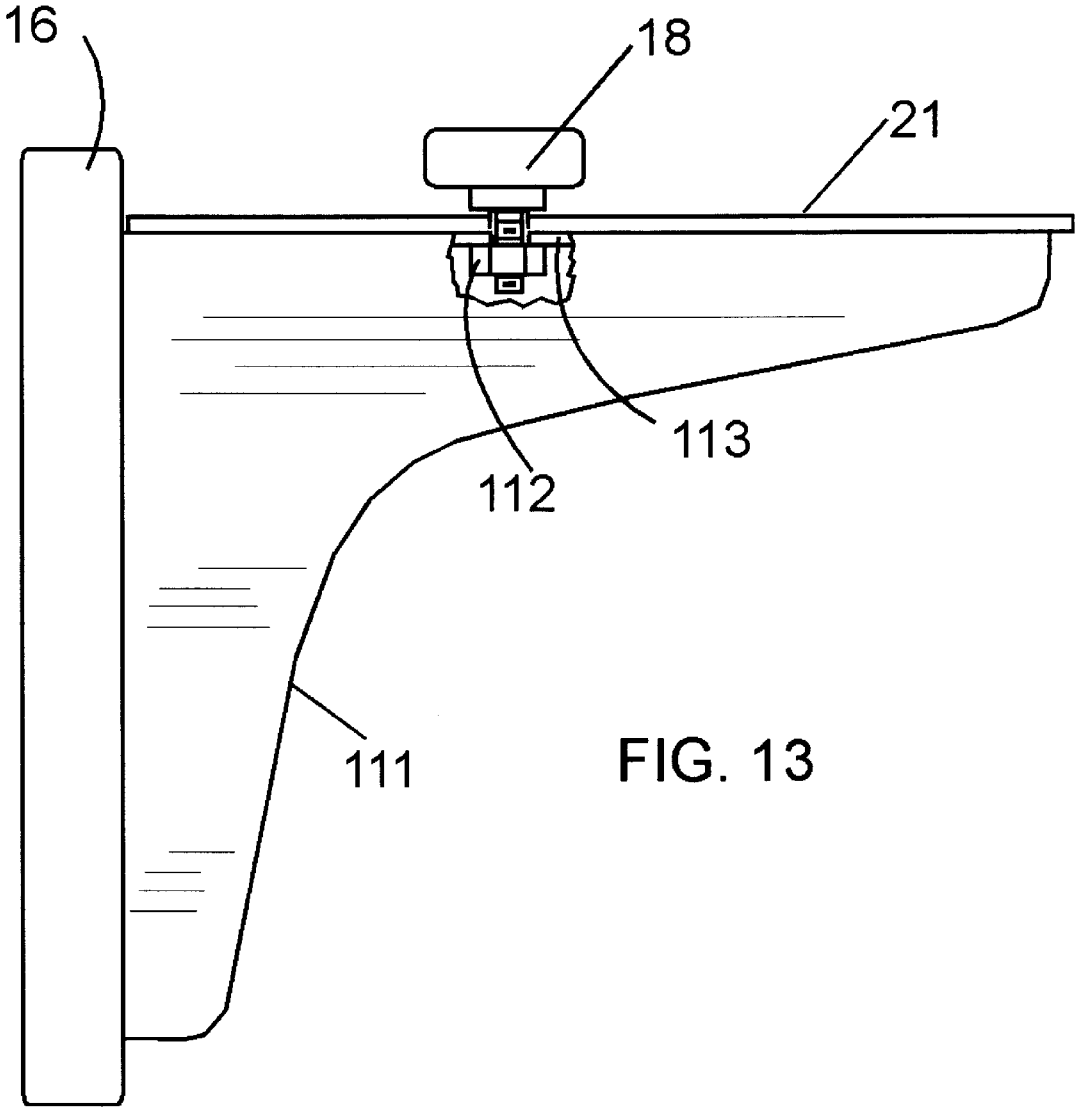
FIG. 13 is a side view of the base plate, wall support and support bracket.

FIG. 13 is an end view of a portion of the machine showing mechanical screw connector 18 for attaching base plate 21 to nut 112 that is held in place to support bracket 111 by plate 113. Support bracket 111 in turn is fixedly attached to wall support 16.

Other variants and combinations of the described mechanical components are possible, especially in the mounting and control of movable components such as the friction pads and magnet, all without departing from the scope of the invention.

Deposit of Computer Program Listings

Not applicable

What is claimed is:

1. A system for providing aerobic exercise comprising:

a) a supporting, non-flexible base for mounting components of said system and for removably attaching said system to a rigid surface;

b) a single, two-ended flexible cord, with snap connector means at both ends for removably attaching hand grips;

c) first and second ports, each having a throat and located at opposed ends of said base for receiving therethrough said cord, two pulleys for guiding movement of said cord within said base and guide means associated with each pulley for assuring contact between each said pulley and said cord;

d) a drum rotatably attached to said base on a drum shaft located between said pulleys and around which one or more turns of the cord is wrapped, and whose surface has a high coefficient of friction to prevent slippage of said cord;

e) a direction-rectify device attached to said base and driven by said drum, such that an output shaft thereof always rotates in a same direction regardless of the rotation direction of said drum;

f) a flywheel rotatable about an axis and attached to and driven by said output shaft at said axis, said flywheel having a radius of rotation larger than the radius of said drum, said flywheel having an annular disk at or near its outer periphery for applying retarding forces; and g) means for applying a frictional retarding force to said disk portion.

2. The system of claim 1, wherein said base is attached to a wall.

3. The system of claim 1, further including a hand grip attached to each end of said cord.

4. The system of claim 3, wherein said hand grips take the form of an individual grip having an attachment point for each hand.

5. The system of claim 3, wherein said hand grips comprise a single shaft having attachment points for said cord close to either end and space for placing hands of a user close to said attachment points.

6. The system of claim 5, wherein paddles can be removably attached to ends of said shaft.

7. The system of claim 1, wherein each of said ports has a throat of conical shape diverging in a direction away from said base, whereby said cord may be guided therethrough at a multiplicity of diverse angles with respect thereto.

8. The system of claim 7, wherein each of said ports is made of a low friction material.

9. The system of claim 1, wherein each of said pulleys is grooved.

10. The system of claim 1, wherein each said guide means comprises an idler wheel.

11. The system of claim 10, wherein each said idler wheel is made of rubber.

12. The system of claim 1, wherein said means for applying a frictional retarding force comprises one or more pads pressing against a flat surface of said flywheel near its outer edge and wherein a force with which said one or more pads press against said disk is adjustable.

13. The system of claim 1, wherein said disk portion of said flywheel is non-magnetic and an additional retarding force is created by a permanent magnet, fixed relative to said base and whose magnetic field passes perpendicularly through said disk portion, thereby generating eddy currents in said disk portion and a consequent retarding torque while said flywheel is moving.

14. The system of claim 13, wherein said additional retarding force is adjustable by means for moving said magnet to different positions on a radial path relative to said disk.

15. The system of claim 1, wherein an additional retarding force applied to said flywheel is created by a multiplicity of vanes extending outward from said flywheel at or near its outer edge, thereby intercepting an air stream during rotation of said flywheel.

16. The system of claim 1, wherein said direction rectifying device comprises a drive gear with an integral one-way clutch mounted on said drum shaft, driving a second mating gear mounted on said output shaft, and a timing belt pulley with integral one-way clutch whose free-running direction is opposite to that of said drive gear and also mounted on said drum shaft, and driving a second pulley mounted on said output shaft with a timing belt, such that the output shaft always rotates in the same direction regardless of the rotational direction of said drum shaft and at approximately the same speed in either direction.

17. A system for providing aerobic exercise comprising:

a supporting, non-flexible base for mounting components of said system and for removably attaching said system to a wall;

a single, two-ended flexible cord, with a hand grip at each of both ends of said cord;

first and second ports made of low friction material and each having a conical throat and located at opposed ends of said base for receiving therethrough said cord, two grooved pulleys for guiding movement of said cord within said base and a rubber idler wheel associated with each pulley for assuring contact between each said pulley and said cord;

a drum rotatably attached to said base on a drum shaft located between said pulleys and around which one or more turns of the cord is wrapped, and whose surface has a high coefficient of friction to prevent slippage of said cord;

a direction-rectifying device attached to said base and driven by said drum, such that an output shaft thereof always rotates in a same direction regardless of a rotation direction of said drum;

a flywheel rotatable about an axis and attached to and driven by said output shaft at said axis, said flywheel having a radius of rotation larger than a radius of said drum, said flywheel having an annular disk at or near its outer periphery for applying retarding forces; and means for applying a frictional retarding force to said disk portion.

18. The system of claim 17, wherein said means for applying a frictional retarding force comprises one or more pads pressing against a flat surface of said flywheel near its outer edge and wherein a force with which said one or more pads press against said disk is adjustable.

19. The system of claim 17, wherein said disk portion of said flywheel is non-magnetic and an additional retarding force is created by a permanent magnet whose magnetic field passes perpendicularly through said disk portion, thereby generating eddy currents in said disk portion and a consequent retarding torque while said flywheel is moving, said additional retarding force being adjustable by lever means for moving said magnet to different positions on a radial path relative to said disk.

20. The system of claim 17, wherein an additional retarding force applied to said flywheel is created by a multiplicity of vanes extending outward from said flywheel at or near its outer edge, thereby intercepting an air stream during rotation of said flywheel.

21. The system of claim 17, wherein said direction rectifying device comprises a drive gear with an integral one-way clutch mounted on said drum shaft, driving a second mating gear mounted on said output shaft, and a timing belt pulley with integral one-way clutch whose free-running direction is opposite to that of said drive gear and also mounted on said drum shaft, and driving a second pulley mounted on said output shaft with a timing belt, such that the output shaft always rotates in the same direction regardless of the rotational direction of said drum shaft and at approximately the same speed in either direction.

22. The system of claim 17, wherein said hand grips comprise a single shaft having attachment points for said cord close to either end and space for placing hands of a user close to said attachment points.

23. The system of claim 22, wherein paddles can be removably attached to ends of said shaft.

* * * * *